US005676269A

United States Patent [19]

Blake et al.

[11] Patent Number: 5,676,269

[45] Date of Patent: Oct. 14, 1997

[54] TAMPER-EVIDENT CLOSURE WITH CAPTIVE BAND

[75] Inventors: Robert R. Blake, Yorktown Heights, N.Y.; Charles M. Tansey, Penshurst, Australia

[73] Assignee: Closures and Packaging Services Limited, St. Peter Port, England

[21] Appl. No.: 665,063

[22] Filed: May 15, 1996

Related U.S. Application Data

[63] Continuation of Ser. No. 408,078, Mar. 22, 1995, abandoned.

[51] Int. Cl.[6] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 3,904,062 | 9/1975 | Grussen . | |
| 4,206,851 | 6/1980 | Ostrowsky | 215/246 |
| 4,530,436 | 7/1985 | Wiedmer | 215/246 |
| 4,557,393 | 12/1985 | Boik | 215/253 |
| 4,805,792 | 2/1989 | Lecinski . | |
| 5,080,246 | 1/1992 | Hayes | 215/252 |
| 5,215,204 | 6/1993 | Beck et al. . | |
| 5,246,125 | 9/1993 | Julian . | |
| 5,248,050 | 9/1993 | Janousch et al. | 215/252 |

FOREIGN PATENT DOCUMENTS

| | | | |
|---|---|---|---|
| 552958 | 7/1993 | European Pat. Off. | 215/252 |
| 3230779 | 2/1984 | Germany | 215/252 |

*Primary Examiner*—Stephen Cronin

*Attorney, Agent, or Firm*—Kilgannon & Steidl

[57] ABSTRACT

A container closure 10 for screw top containers such as beverage container, the closure 10 having a generally cylindrical tamper-evident band 11 joined by a plurality of frangible bridges **13*b*, 13*c* and at least one extended non-frangible bridge 13*a* to the free edge of a skirt 16 of the closure 10. The band 11 has a segmented internal rib 18 which engages an external retaining flange 30 of the container 29 when the closure is applied to the container. An L-shaped slot 17 extends through the side wall of the tamper-evident band 11, the horizontal leg 61 of which terminates directly adjacent to or under the extended non-frangible bridge 13*a*. A weakened frangible region 63 of the band extends from the terminating end 62 of the horizontal leg 61 axially downward to the bottom of the band 11. On removal of the closure 10 from the container 29, the frangible bridges 13*b*, 13*c*and frangible region 63 rupture and the band 11 remains captive at the extended bridge 13*a* to the skirt. Longitudinal internal projections 25 and 28 circle the band 11, except in the region of the L-shaped slot 17 to allow stretching of the band adjacent the slot. Thickenings 26 circle the band except in the region of the slot 17 and except at approximate quarter-turns 71, 72** around the band from the slot, allowing stretching of the band where absent for application to the container.

12 Claims, 7 Drawing Sheets

TAMPER-EVIDENT CLOSURE WITH CAPTIVE BAND

This application is a continuation of application Ser. No. 08/408,078 filed Mar 22, 1995 now abandoned.

FIELD OF THE INVENTION

The present invention relates to plastic closures for containers having an externally screw threaded neck and more particularly to such closures which are formed with a tamper-evident, captive, band. When such closures are removed from the container, the tamper-evident band is ruptured but remains attached to the closure.

BACKGROUND OF THE INVENTION

Manufacturers of beverages, foodstuffs and the like are concerned with ensuring that products they place on the market are not tampered with before being opened by the ultimate consumer of the goods. For this purpose it has become conventional to include in closures for such goods means which will indicate whether the closure has been tampered with before purchase. In the case of containers having an externally screw threaded neck, it is common to provide the closure with a tamper-evident band which engages underneath a retaining flange formed on the neck of the container. The tamper-evident band is joined to a depending skirt forming part of the closure by a number of frangible bridges. On application of the closure to the container the band is forced over the retaining flange, however, when the closure is unscrewed from the container the bridges are sheared as the band is trapped underneath the retaining flange while the closure moves up the neck of the container. Tampering by unscrewing the closure will therefore be apparent.

While such tamper-evident bands have been widely accepted, there is a delicate balance between conflicting requirements. On the one hand, one must be able to both remove the plastic closures from their molds and apply the closures to containers at very high speed without inadvertently breaking the bridges, or breaking or deforming the band itself, or deleteriously affecting the seal between the closure and the container. On the other hand, after the closure has been fully applied to the container, the tamper-evident band must be tightly secured underneath the container retaining flange, and bottlers' requirements for such tight securement are becoming increasingly rigorous. Further, the bridges must be sufficiently easily broken that the closure cannot be unscrewed from the container without rupturing the bridges.

An additional problem associated with temper-evident bands is that an unauthorized person may attempt to remove the closure and tamper-evident band without damaging the band or frangible bridges, in order to contaminate or replace the container contents and then reapply the closure. Such operation may be attempted with the assistance of a thin device, such as a knife blade, wedged up between the tamper-evident band and the neck of the container to which the closure has been applied. The knife blade may then be levered outwardly in order to expand the inner diameter of the band so that it may be passed back over the retaining flange of the container. In such a process the knife blade will be edged around the circumference of the band so as to gradually ease the band over the retaining flange at a continuously lengthening portion of the band circumference. Means are needed to prevent such tampering.

It also is becoming increasingly desirable around the world to recycle, or wash and refill, beverage bottles and other containers. However, various types of closures with tamper-evident bands leave the band remaining on the container when the main portion of the closure has been unscrewed from the container. As the closure is unscrewed, the frangible bridges rupture and the then-detached band drops down on the container neck. This band must later be first removed from the container neck before the recycling/reuse processes are carried out on the container. Accordingly, captive tamper-evident bands have been developed which have both frangible bridges but also retaining means to maintain the band attached at a portion thereof to the remainder of the closure when the closure is totally removed from the container. In certain instances, one or more vertical slots in the side wall of the tamper-evident band have been used adjacent extended bridges to result in the tamper-evident band completely breaking through axially along its side wall to facilitate removal of the closure with the partially detached band. In other instances, for example, as disclosed in U.S. Pat. No. 5,246,125 (Julian) L-shaped slots have been used in the side wall of the tamper-evident band, which band does not break but rather depends on substantial axial deformation of the band above the horizontal leg of the L-shaped slot in order to remove the closure with its captive band from the container. U.S. Pat. No. 5,215,204 (Beck et al) also illustrates an L-shaped slot in a tamper-evident band, wherein the band does not break, requires substantial circumferential deformation of the band tether above the horizontal leg of the L-shaped slot, and provides for keeping the band on the container when the remainder of the closure is removed, the tether remaining attached to both the band and the closure. Other patents including U.S. Pat. Nos. 3,904,062 (Grussen), 4,557,393 (Boik) and 4,805,792 (Lecinski) provide for L-shaped slots in banded configurations, but again where the bands do not breaks and, where the L-shaped slots are above the tamper-evident band, there are multiple rows of bridges, and the tamper-evident band is retained on the container by a tether when the remainder of the closure is removed. Tamper-evident bands with slots need to meet all of the above-described conflicting requirements of tamper-evident bands, and yet also not result in the side wall of the band breaking during removal of the closure from the mold and application of the closure to the bottle. The band must not break, if at all, until the closure is ready to be removed from the container. Prior art slotted configurations have generally involved complicated design arrangements and/or designs in which the bridges or band may rupture during application to the container or prematurely and inconsistently when the closure has first begun to be removed from the container, and/or designs in which excessive force is required to remove the closure from the container, etc.

In short, tamper-evident closures with captive bands must be easily removed from the mold and easily applied to the container without breakage of the band and/or bridges, must be tightly securable under the container flange and yet easily removed without excessive force from the container, must be completely tamper-evident, and must have a band that will consistently rupture at the same place in order to provide a captive band when the closure is removed from the container. Closures of the type mentioned above are used around the world in increasingly large numbers. To be commercially acceptable such closure must also be capable of being produced very rapidly in automated machinery. This itself may produce a conflict with the functionality of the closure and/or its tamper-evident, captive, band.

The arrangement according to the present invention is designed to provide the public with an alternative and superior form of closure having a tamper-evident, captive, band.

SUMMARY OF THE INVENTION

The present invention in broadest scope consists of a closure for a container having an externally screw threaded neck, the closure comprising a top portion and a depending skirt which has on its internal surface a complementary screw thread, a free edge of the depending skirt being joined by a plurality of bridges to a tamper-evident band, the band comprising a generally cylindrical body portion and a segmented rib extending inwardly of the body portion and adapted to provide a lip to engage under a retaining flange extending outwardly from the neck of the container below the screw thread thereon, the rib having an upper side facing generally towards the top of the closure and an under side facing generally away from the top. The majority of the bridges are frangible, but one circumferentially extended bridge is non-frangible to retain the tamper-evident band captive to the remainder of the closure after the closure is unscrewed from the container. An L-shaped slot is positioned in and extends radially through the side wall of the tamper-evident band. The L-shaped slot has a vertical leg extending from the top of the tamper-evident band and positioned near to an end of the circumferentially extended bridge. The L-shaped slot's horizontal leg extends towards said extended bridge to terminate under or directly adjacent the end of the extended bridge. The side wall of the tamper-evident band extends below the horizontal leg of the L-shaped slot, and has a radially thinned region extending from the horizontal leg to the bottom of the closure under the terminating end of the horizontal leg. When the closure is unscrewed from the container, the frangible bridges will rupture and the radially thinned region of the band side wall under the end of the horizontal leg will also rupture from top to bottom in a consistently easy manner and only at that particular location where the forces are concentrated. The closure is then removed with a low amount of torque from the container with the band captive to the remainder of the closure at the non-frangible extended bridge. The side wall of the tamper-evident band below the horizontal leg will resiliently stretch circumferentially without breaking when the closure is removed from its mold and applied to the container, thus assisting in both operations.

A further aspect of the present invention relates to the segmented rib having alternate projections disposed both beneath the gaps between the rib segments and also beneath the mid-points of the underside of the rib segments, said latter projections abutting the undersides of the segments. Such inward projections are shown in International Publication Number WO 94/02371 published Feb. 3, 1994. The rib segments in the present invention are omitted adjacent to both sides of the L-shaped slot, however, as are the above-described alternate projections. Accordingly the side wall of the tamper-evident band can more easily resiliently stretch adjacent to the L-shaped slot, and application of the closure to the container is facilitated without breakage of the band or the frangible bridges. In the remainder of the circumference of the band, the rig segments and alternate projections are present. These projections are preferably inclined radially inward as they approach the rib, however they do not extend inwardly from the radially inner surface of the body portion of the band as far as the rib segments do. The alternate projections make it difficult for tampering by a thin knife, etc. being inserted under the bottom edge of the band to pry the band off of the container without breaking the frangible bridges.

A still further aspect of the present invention relates to the outside of the body portion of the tamper-evident band being provided with outward projections or other localized areas of thickening to enhance the axial stiffness of the body portion while still permitting it to expand radially as it is forced during application over the retaining flange on a container. Such outward projections are shown in International Publication Number WO 94/02371 published Feb. 3, 1994, but in the present invention the localized areas of thickening may be deleted at positions spaced approximately ninety degrees from the L-shaped slot. The omission of the radial rib segments adjacent both sides of the L-shaped slot creates a stronger radially-outward pressure on the tamper-evident band at these ninety degree positions when the band is applied to the container. The omission of localized areas of thickening at those positions enhances the resilient expansion of the closure at those positions on application to the container, and avoids excess pressure on the band below the L-shaped slot.

Other features and advantages of the present invention will be apparent from the following description, drawings, and claims.

DETAILED DESCRIPTION OF EMBODIMENT

While the present invention may be embodied in various forms, the drawings show and there will hereinafter be described a preferred embodiment of the invention. It should be understood, however, that the present description is not intended to limit the invention to the specific embodiment described.

Figure 1:
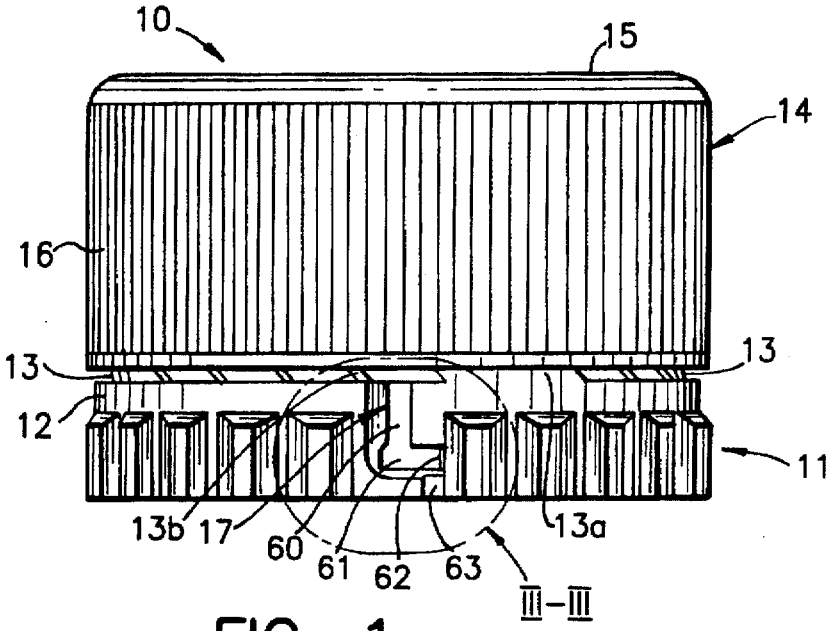
FIG. 1 is a side elevational view of the tamper-evident plastic closure with captive band of the present invention.

Referring to FIG. 1, the tamper-evident plastic closure 10 includes a tamper-evident, captive, band 11 having a generally cylindrical body portion 12 attached by bridges 13 to a cap portion 14 of the closure 10. The cap portion 14, bridges 13 and tamper-evident band 11 may be formed integrally by injection molding from suitable material such as polyethylene or polpropylene. One bridge 13*a* is non-frangible, and the remaining bridges 13*b* and 13*c* are frangible. The cap portion 14 includes a circular top 15 and a depending skirt 16. The inside of the skirt 16 is screw threaded and adapted to be attached to containers commonly made from glass or a plastics material such as PET and which have an externally screw threaded neck.

Figure 2:
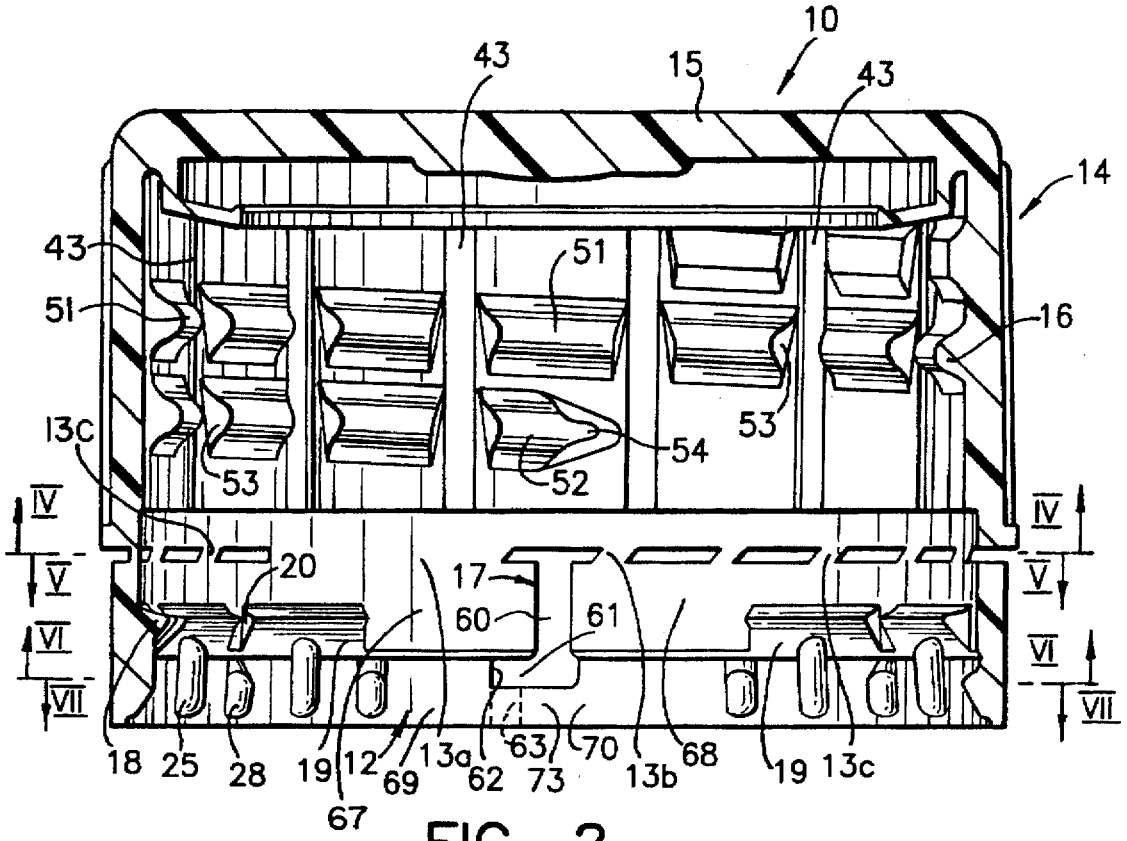
FIG. 2 is a closure diametric cross-sectional view towards the inside of the closure outside illustrated in FIG. 1.
Figure 3:
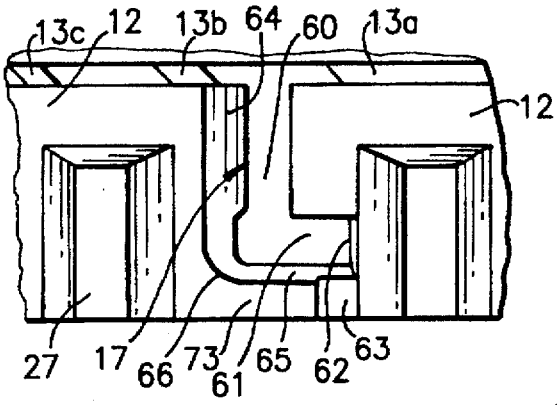
FIG. 3 is an enlarged view of a portion of the closure shown in FIG. 1.

The generally cylindrical body portion 12 of tamper-evident band 11 contains L-shaped slot 17, shown in enlarged view in FIG. 3, extending radially completely through the wall of band 11. Slot 17 has a vertical portion or leg 60 and a horizontal portion or leg 61. Below the horizontal leg 61 is portion 73 of body portion 12 of band 11, and positioned below the outer end 62 of the horizontal leg 61 is a radially-thinned region 63 of portion 73. Outer end 62 of horizontal leg 61 leads the remainder of the slot as the closure is unscrewed from the container. Merely as an example, in what is known as a 28 mm beverage closure, the vertical dimension of slot 17 from the bottom of the slot in FIG. 2 up to the bottom level of the bridges 13 may be of the order of approximately 4.5 mm; the horizontal dimension of slot 17 from outer end 62 in FIG. 2 to the other opposite end of the slot may be of the order of approximate 3 mm; the radial thickness of portion 73 may vary upwardly from the free edge of the band from approximately 0.4 mm, the radial thickness of region 63 then being less and the vertical dimension of region 73 in FIG. 2 may be approximately 1.4 mm.

Bridges 13 attaching body portion 12 of band 11 to cap portion 14 are not all of equal circumferential length around the circumference of the closure. Referring to FIG. 2, extended non-frangible bridge 13*a* is of much greater circumferential length than any of the other bridges, bridge 13*a* for example occupying approximately thirty-two degrees around the circumference of the closure. Referring to FIGS. 2 and 3, the outer end 62 of horizontal leg 61 of L-shaped slot 17, and radially-thinned region 63 of portion 73, lie under bridge 13*a*. Outer end 62, if not extending under bridge 13*a*, should lie directly adjacent bridge 13*a*. Outer end 62 also may extend a partial distance under bridge 13*a*, for example a third or so of the circumferential length of bridge 13*a*.

Figure 4:
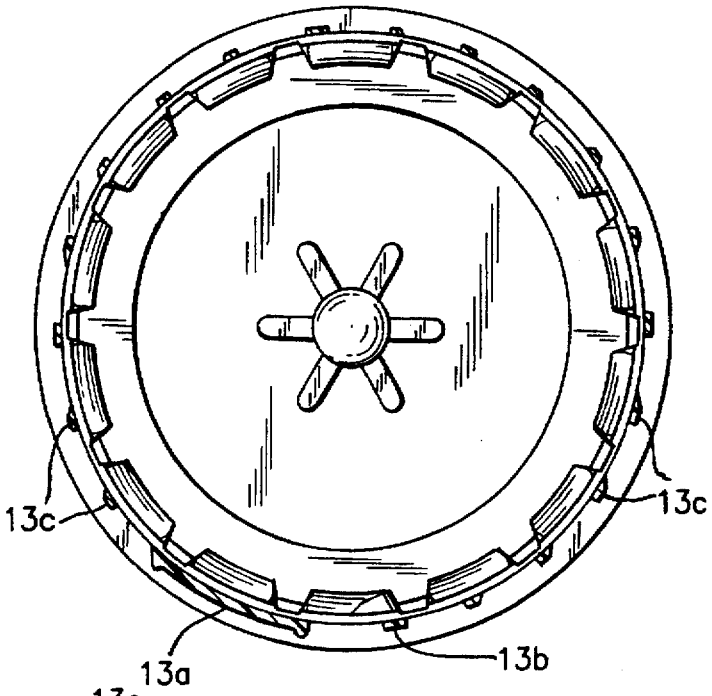
FIG. 4 is a view of the closure shown in FIG. 1 taken along section IV—IV of FIG. 2.
Figure 5:
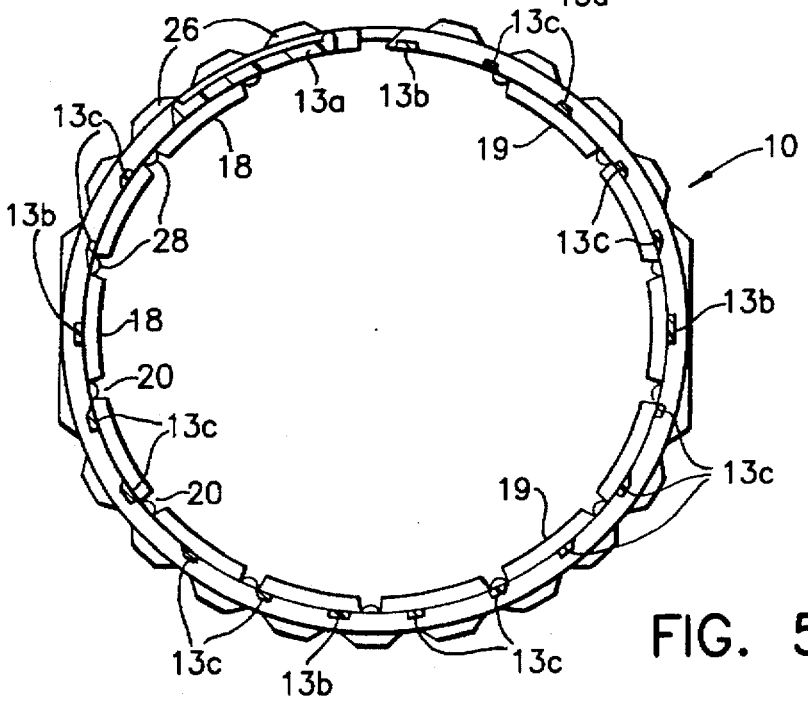
FIG. 5 is a view of the closure shown in FIG. 1 taken along section V—V of FIG. 2.

A shorter bridge 13*b* is positioned on the opposite side circumferentially of slot 17 from bridge 13*a*, frangible bridge 13*b* being considerably shorter circumferentially than bridge 13*a*, for example being approximately 0.8 mm long in the circumferential direction. Three other frangible bridges 13*b* of the same circumferential length are positioned at other positions around the circumference of the closure as shown in FIG. 5. The four bridges 13*b* in effect prevent the weaker bridges 13*c* from rupturing when the closure is removed from the mold and applied to the container. Sixteen other frangible bridges 13*c*, of even shorter circumferential length (for example 0.5 mm) than frangible bridges 13*b*, are spaced around the remainder of the closure at approximately equal distances. Bridges 13*a*, 13*b* and 13*c* are considerably thinner in their radial dimensions than the skirt and the band, and the inner surface of the bridges lies flush with the respective radially inner surfaces of the skirt and the band. However, non-frangible bridge 13*a* is thicker radially than frangible bridges 13*b* and 13*c*, and additionally may have even greater radially thickened ends (as can be seen in FIG. 4) to prevent rupturing. It may be desirable that bridge 13*a* not be rupturable by the closure user even after the closure is removed from the container, so that a user cannot drop and leave a free band in an empty container subsequently meant for recycling/reuse; otherwise, the term "non-frangible" in relation to bridge 13*a* is meant to mean that bridge 13*a* will not rupture as the closure is removed from the container. Bridges 13*b* have a radial thickness (for example 0.30 mm) less than bridge 13*a* (for example 0.50 mm except at the thickened ends) and more than bridges 13*c* (for example 0.24 mm).

Figure 14:
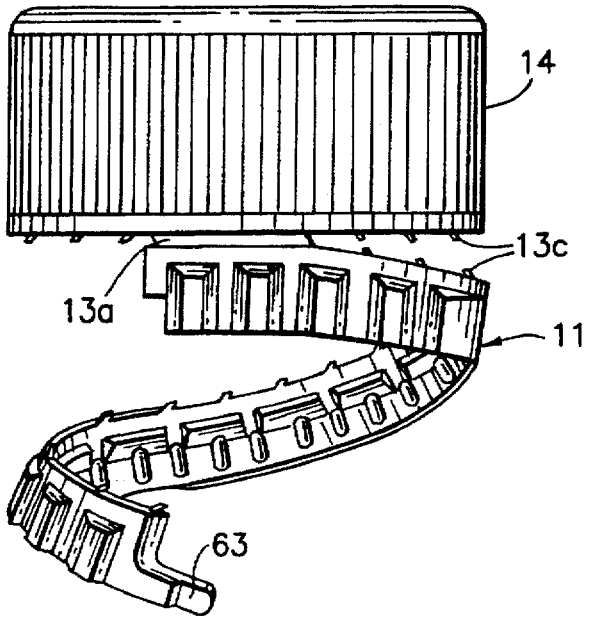
FIG. 14 is a side elevational view of the closure shown in FIG. 1 with the tamper-evident band being largely separated from, but still captive with, the remainder of the closure.

When closure 10 is removed from the container it has been screwed onto, frangible bridges 13*b* and 13*c* will break. L-shaped slot 17 in conjunction with radially-thinned region 63 of body portion 12 and extended non-frangible bridge 13*a* will act to rupture body portion 12 of band 11 only at region 63, between the bottom of slot 17 and the bottom of closure 10. During the removal process, the elongated bridge 13*a* and the wall of the band extending downwardly therefrom to the free edge of the band do not significantly deform in an axial direction. The tamper-evident band 11 will remain captive to cap portion 14 at bridge 13*a*, but will be otherwise detached from cap portion 14, as shown in FIG. 14. The areas 64 and 65 shown in FIG. 3 adjacent respectively to the vertical leg 60 and horizontal leg 61 of slot 17 are also progressively radially thinned toward the slot from the remainder of body portion 12 of band 11, and together with radius 66, assure that body portion 12 only ruptures at region 63 when closure 10 is unscrewed from its container. By assuring this same point of rupture, the closure 10 can be removed from the container with the same low degree of torque each time.

Figure 11:
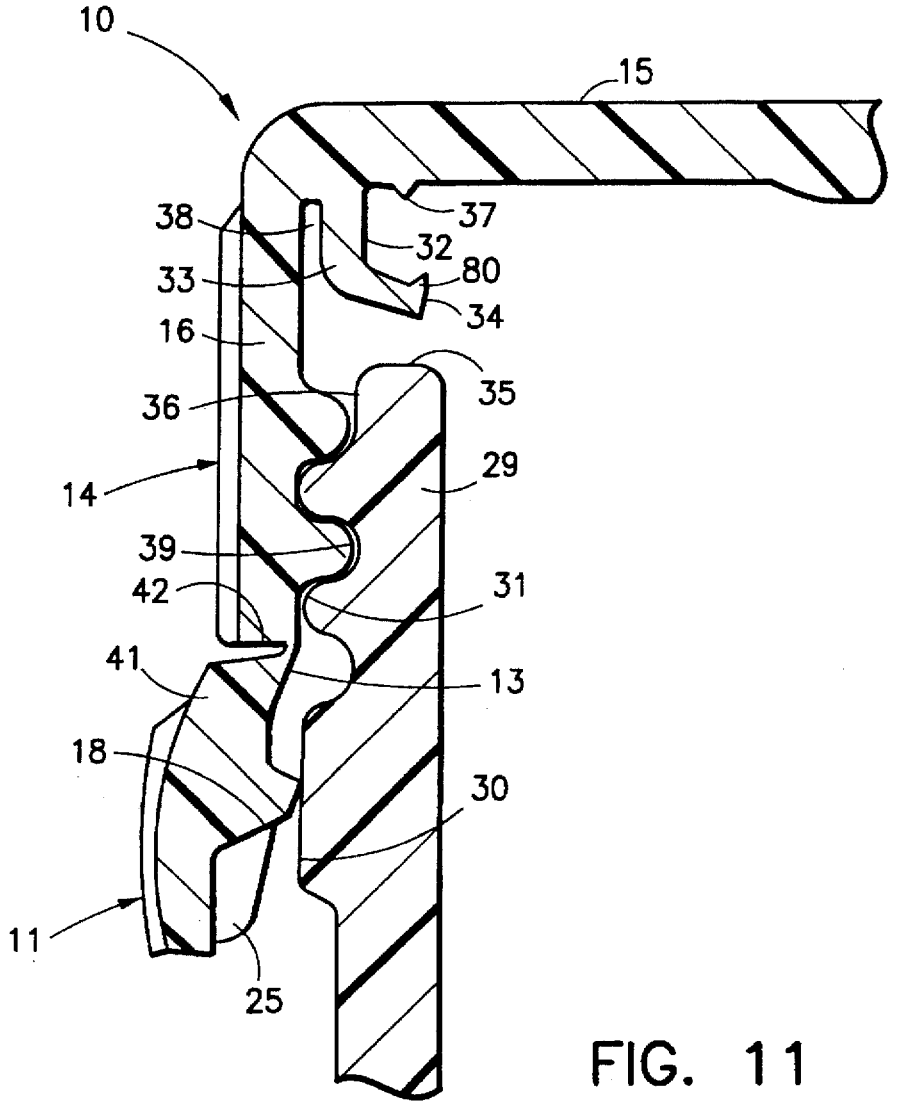
FIG. 11 is a partial cross-sectional view in an enlarged scale of the closure of FIG. 1, shown the closure in relation to a neck of a container as the closure is being screwed onto the container.
Figure 12:
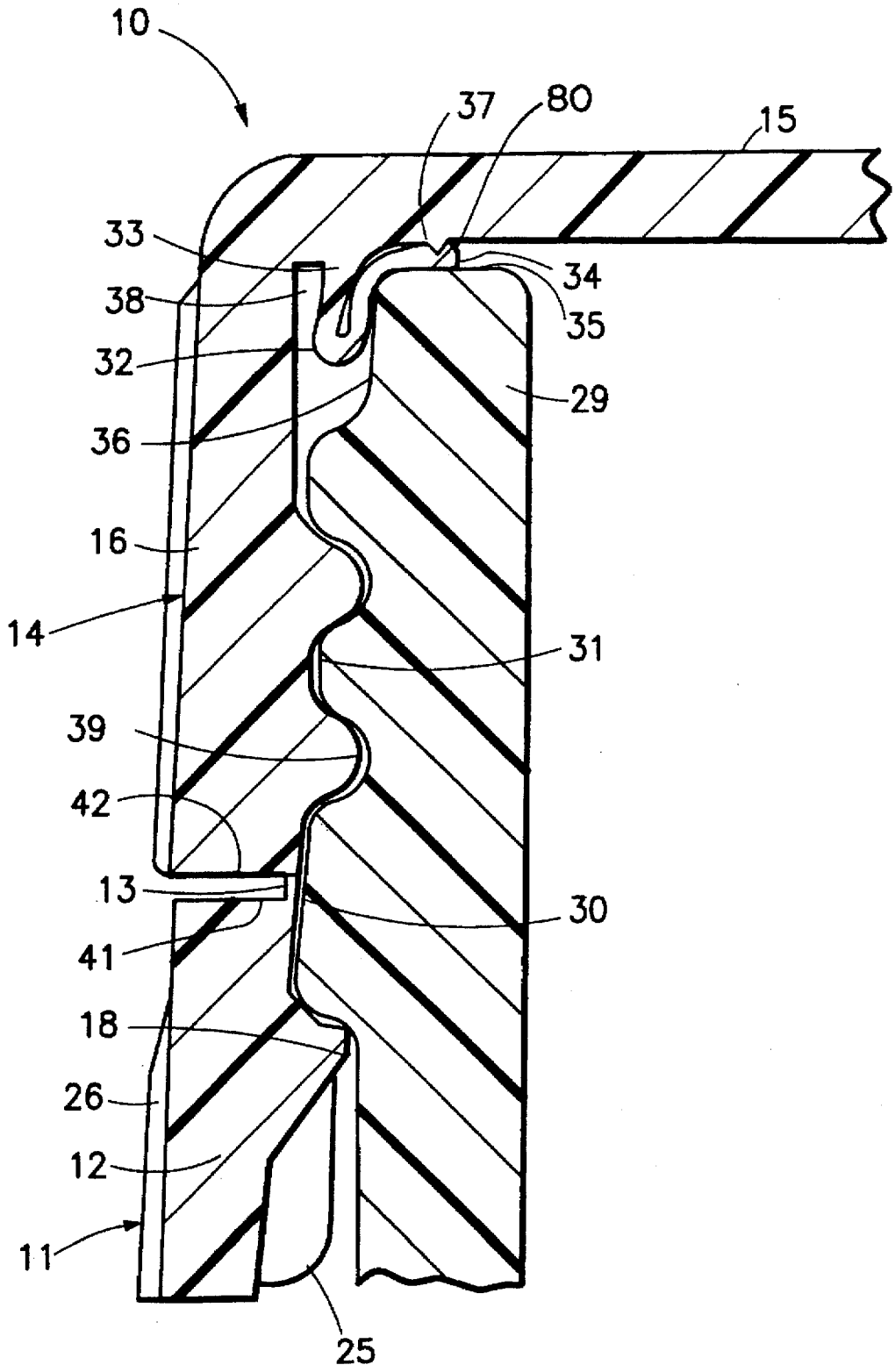
FIG. 12 is a partial cross-sectional view showing the closure of FIG. 11 with the closure sealingly engaged with the neck of the container.

Turning now to attachment of closure 10 to the container, the container 29 (a portion of which is shown in FIGS. 11 and 12) includes a continuous generally annular retaining flange 30 immediately below the screw thread 31 of the container 29 so as to form an outwardly radially directed lip. The band 11 includes a rib 18 about its inside surface being sized and shaped so as to provide an inwardly extending lip which will engage under the retaining flange 30 of the container 29 once the closure 10 is fully closed onto the container 29.

Figure 6:
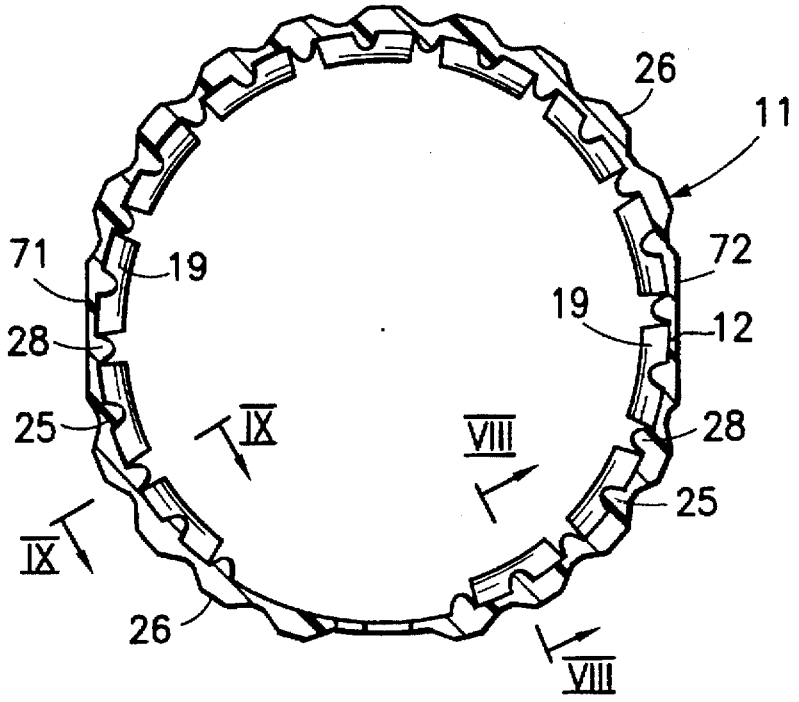
FIG. 6 is a view of the closure shown in FIG. 1 taken along section VI—VI of FIG. 2.
Figure 7:
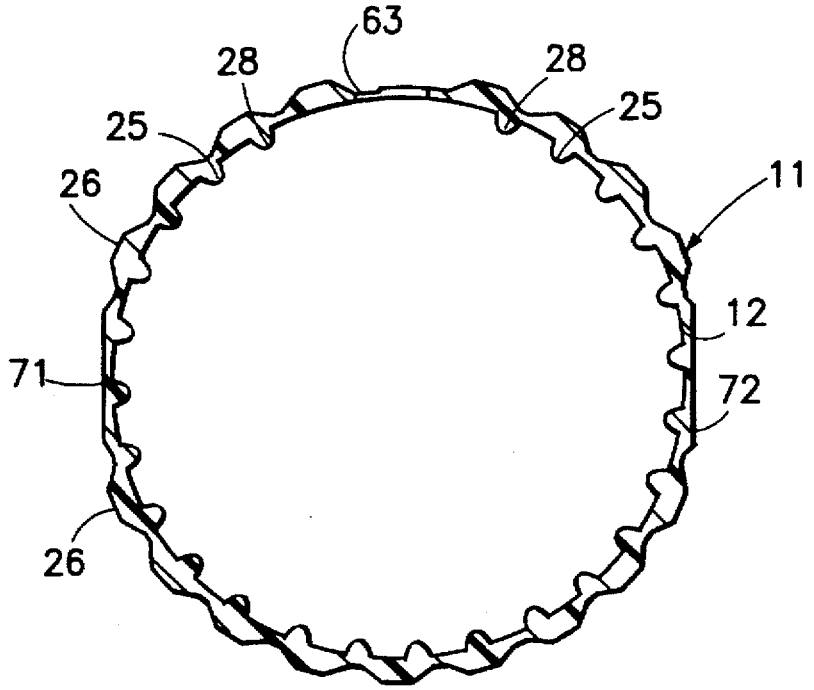
FIG. 7 is a view of the closure shown in FIG. 1 taken along section VII—VII of FIG. 2.

The rib 18 is made up of a series of rib segments 19 separated by short breaks 20 as shown in FIGS. 2,5 and 6, the rib segments 19 being generally equally spaced (except in the region of L-shaped slot 17), constituting most of the circumference of the band and acting together as though the rib 18 were in large part continuous. The breaks 20 provide circumferential flexibility to the band and allow the rib 18 to pass over the retaining flange 30 without stress sufficient to break the frangible bridges. It will be noted from FIG. 2, however, that the rib segments 19 are absent on opposite sides of slot 17 to provide circumferential regions 67,68 of enhanced circumferential stretching expansion when closure 10 is removed from its mold and also when closure 10 is threaded onto container 29.

Figure 9:
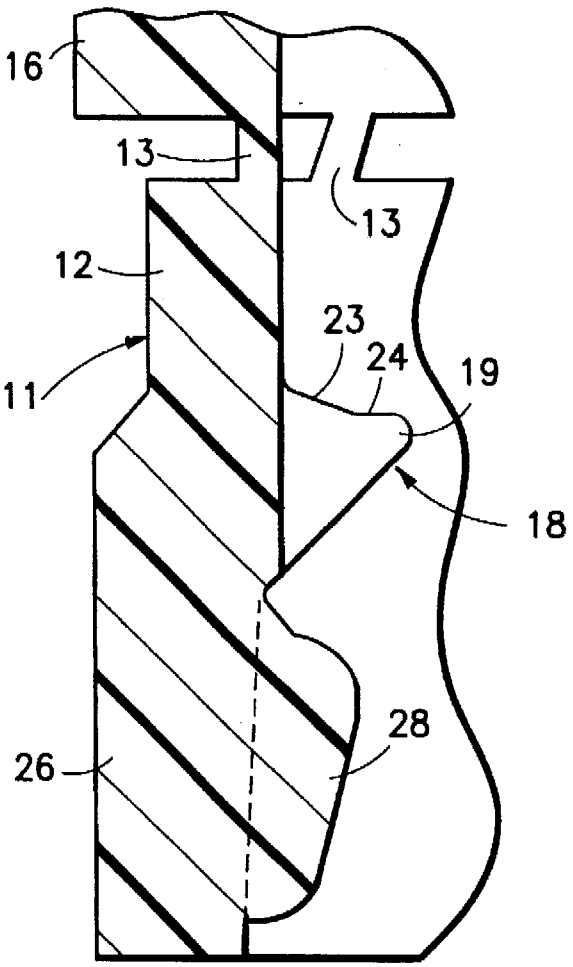
FIG. 9 is a view of the closure shown in FIG. 1 taken along section IX—IX of FIG. 6.
Figure 8:
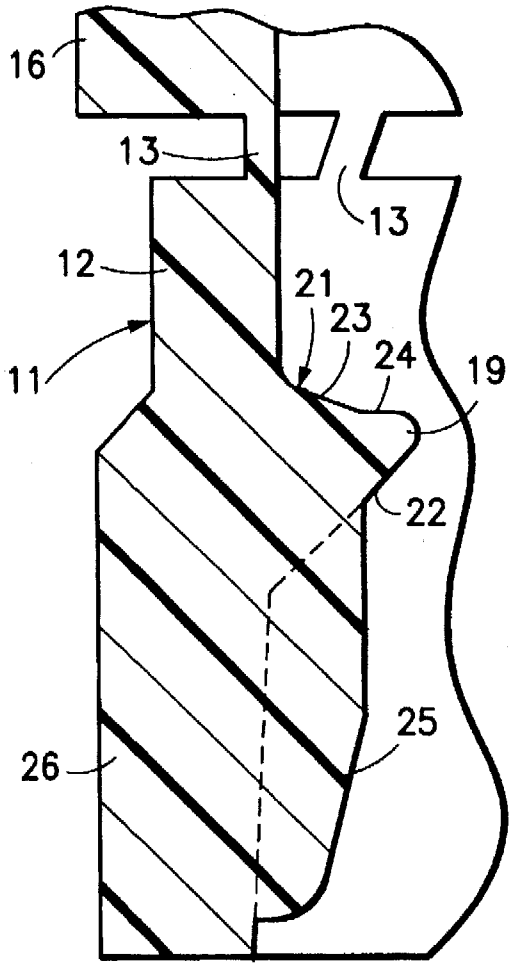
FIG. 8 is a view of the closure shown in FIG. 1 taken along section VIII—VIII of FIG. 6.
Figure 10:
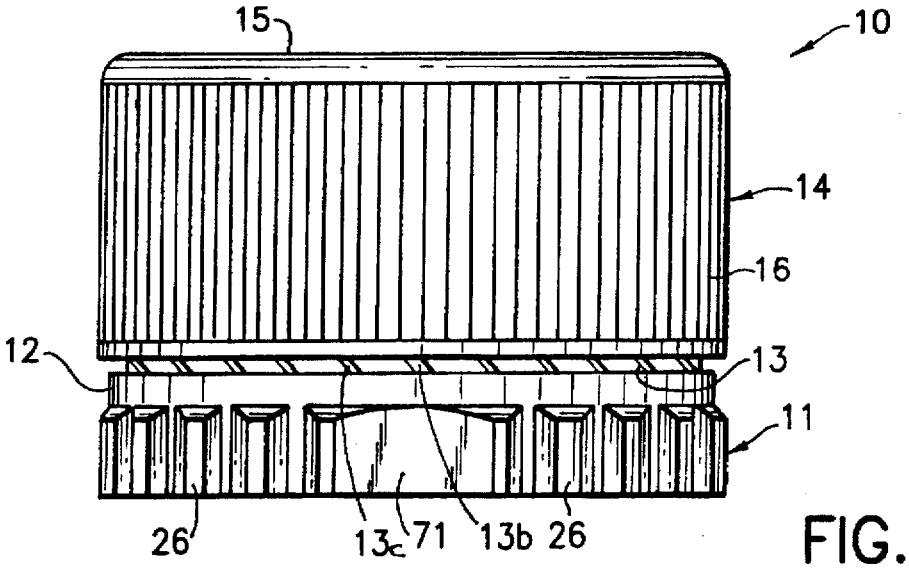
FIG. 10 is a side elevational view of the closure shown in FIG. 1 rotated ninety degrees about the vertical axis of the closures.

Referring to FIGS. 8 and 9, the rib 18 has an upper side 21 directed towards the top portion 15 and an under side 22 directed away from it. The upper side 21 includes a radially outer frusto-conical surface 23 and a radially inner annular surface 24. The annular surface 24 lies in a plane normal to a longitudinal axis of the closure 10 while the frusto-conical surface 23 is inclined inwardly and downwardly away from the top portion 15 and makes an angle of about 20° with the plane normal to the longitudinal axis of the closure. The outer frusto-conical surface 23 and the inner annular surface 24 each comprise about one half of the radial width of the upper surface of the rib 18. In use it is the annular surface 24 which engages under the flange 30 on the neck of the container 29 to which the closure 10 is attached. The presence of the frusto-conical surface 23 assists in the molding of the closure 10 as it prevents or a least substantially reduces the production of closures having deformed ribs 18. It also ensures rigidity of the rib 18 and thereby prevents distortion of the rib 18 as it is forced over the retaining flange 30 as the closure 10 is screwed down onto the container 29. The rib 18 is sufficiently robust that it can, on its own, withstand the forces applied to it during application to the container 29 and also prevents the cap 14 from being removed without breaking the frangible bridges 13*b* and 13*c* either by normal removal of the cap 14 or due to tampering with the container 29. It has been found that there is no deleterious effect in not having the annular surface 24 extend across the full width of the upper surface 21 of the rib 18.

Below the rib 28, and still on the inside surface of the body portion 12 of the band 11, is an arrangement shown particularly in FIGS. 2,8 and 9 of a plurality of inwardly extending projections 25 and 28, each having a long axis generally aligned with the longitudinal axis of the closure 10. The projections 25 and 28 extend radially inwardly from the inner surface of the body portion 12 sufficiently to come into contact with the retaining flange 30 during application of the closure 10 to the container 29 and once the container is capped to lie close to the outer neck surface of the container 29. Each alternate inwardly extending projection 28 is spaced below the break 20 in the substantially continuous rib 18 and is not connected to the rib 18. Each of the remaining inwardly extending projections 25 are connected at one end to the center of a rib portion 19. It will be noted that projections 25 and 28 are also absent on opposite sides of slot 27, also to provide regions 69,70 of increased circumferential stretching expansion when closure 10 is removed from its mold and also when closure 10 is threaded onto container 29.

The radially inner free edge of each rib segment 19 projects inwardly well beyond the innermost extent of the projections 25 and 28 and must be sufficiently sturdy to be self-supporting during application of the closure 10 to the container 29 and in preventing the band 11 from riding up over the retaining flange 30.

The projections 25 and 28 prevent a person from introducing a device such as a knife blade radially inwardly of the body portion 12 of the band 11 and progressively moving the device circumferentially around the band 11 in an effort to gradually force the rib 18 up and over its mating flange 30 on the container 29.

Along the outside surface of the band 11 are a number of reinforcements or thickenings 26. Each thickening 26 extends from a region adjacent the level of rib 18 to a region at the free end of the band 11. The thickenings 26 in conjunction with the inwardly extending projections 25 and 28 strengthen the band 11 and thus enhance the vertical stiffness of the band 11 whilst retaining a sufficient horizontal or radial flexibility. This also allows sufficient axial force to be applied to the free end of the closure 10 to successfully eject the closure 10 from a core portion of a mold used in its production.

The outer surfaces of the thickenings 26 present substantially flat lands 27 which lie radially just outside the radial extent of the rest of the closure 10 to allow the land to be mechanically gripped or otherwise contacted without necessarily contacting the skirt. It will be noted from FIGS. 5,6,7 and 10 that reinforcements or thickenings 26 are not present at elongated region 73 under the L-shaped slot, and are absent at two diametrically opposite positions 71,72 around the circumference of the closure, which positions 71,72 are each spaced a quarter turn from slot 17. Unreinforced positions 71,72 provide regions of enhanced circumferencial stretching expansion when closure 10 is threaded onto container 29.

Referring to FIGS. 11 and 12, the closure 10 is formed with a sealing arrangement which may take several known forms. As here disclosed, the sealing arrangement includes a concentric annular rib 32 which extends from the underside of the top portion 15 of the cap portion 14. The annular sealing rib 32 includes a first or root portion 33 which extends downwardly from the top portion 15 approximately parallel to the skirt 16 with a second portion 34 which, prior to engagement with the neck of the container 29, tapers inwardly and away from the skirt 16. Second portion 34 has annular ridge 80 positioned at its end.

The second portion 34 of the rib 32 contacts the end 35 of the container 29 as the closure 10 is being screwed onto the container 29, and the second portion 34 is caused to fold up against the surface of the first portion 33. Thus there is formed a continuous gas tight seal between the closure 10 and the container 29 extending up the side wall 36 of the container 29 to the end 35 of the container 29.

As the closure 10 is screwed onto the neck of the container 29, the second portion 34 of the sealing rib 32 is deformed by being bent towards the top 15. The deformation continues and contact is made as shown in FIG. 12 between the second portion 34, its ridge 80, and an inner annular ridge 37 on the inside surface of the top 15.

Once the second portion 34 has contacted the top portion 15, further movement attaching the closure 10 will press and grip the contacting part of the second portion 34 between the container end 35 and the top portion 15. As the movement attaching the closure 10 continues, it tends to pinch the free edge of ridge 32 between the container 29 and the top portion 15 and to "pull" the first portion 33 of the annular ridge 32 tightly in towards the container end 35 to produce a right seal about the curved edge surface of the container 29 extending from its extreme end annular surface 35 down the side wall 36.

As the closure 10 is screwed onto the neck of the container 29, the screw thread 31 also engages the thread 39 on the interior surface of the skirt 16. As the closure 10 moves down the neck of the container 29 the frangible bridges 13*b* and 13*c* form an annular weak zone which allows the rib 18 to diametrically expand over the retaining flange 30 of the container 29.

In this embodiment the axis of each frangible bridge 13*b* and 13*c* is inclined such that when seen in side elevation the upper end of each bridge 13*b* and 13*c* is inclined to the left relative to its lower end. The bridges 13*b* and 13*c*, therefore, bend as the closure 10 is screwed clockwise onto the container 29. As the rib 18 expands over the flange 30, the lower edge 42 of the skirt 16 and the upper edge 41 of the band 11 have room to flex towards each other while still having the bridges 13*b* and 13*c* therebetween. This stabilizes the band 11 and reduces the likelihood of the bridges 13*b* and 13*c* breaking during application. As the closure is unscrewed, the bridges 13*b* and 13*c* are straightened out, concentrating the forces to rupture bridges 13*b* and 13*c*.

During the above-described expanding of the ribs 18 over the flange 30 (as well as when closure 10 is removed from the mold), regions 67,68,69,70 and 73 permit the wall of body portion 12 in those regions to circumferentially stretch, particularly at elongated region 73. This stretching in these regions assists in preventing the frangible bridges 13*b* and 13*c* from breaking during application of closure 10 to the container 29.

Once the rib 28 has passed over and engaged under the flange 30, the frangible bridges 13 return to their extended orientation (FIG. 12). As the closure 10 begins to be unscrewed from the neck of the container 29, the rib 18 detains the band 11 under the flange 30. As the closure 10 is unscrewed further, the bridges 13*b* and 13*c* are straightened which serves to concentrate the forces tending to rupture the bridges 13*b* and 13*c* at the point of attachment of each bridge 13*b* and 13*c* to the band 11 and to the skirt 16.

As is best seen in FIG. 2, inside the skirt 16 is a thread made up of a plurality of thread segments 51 arranged in spaced apart array along the locus of the thread. Each thread segment, except the first segment 52, is bounded at each end by a planar surface 53. Each of the planar surfaces 53 is inclined to the longitudinal axis of the closure 10 so that it faces away from the top 15.

The first thread segment 52 is formed with a planar surface 53 on its trailing edge, however it is formed with a point 54 on its leading edge to assist in mating the thread on the closure 10 with a corresponding thread on the neck of the container 29.

The thread segments 51 in each turn of the thread are aligned as are the spaces between them. A groove 43 is formed on the inside surface of the skirt 16 in each of the aligned spaces between adjacent thread segments 51. The grooves 43 serve to assist in venting gas from a carbonated beverage container as the closure 10 is unscrewed. The aligned grooves between adjacent thread segments may be aligned with the grooves between the rib segments.

The end faces of each of the rib segments 19 are each angled as has been described in respect of thread segments. This reduces the likelihood of the ends of the rib segments 19 being damaged as the closure 10 is ejected from a mold. The planar end surfaces of both the thread and the rib segments are also inclined to a notional radial plane extending from the axis of the closure to the end of the respective segment such that the ends are inclined to the skirt of the closure by an included angle that is less than the included angle that the respective notional plane makes with the skirt.

The closure 10 is molded on a mold core which defines, inter alia, the inside surface of the skirt 16, the thread segments 51 and the grooves 43. It has been found that by forming the thread segments 51 with planar surfaces 53, damage to the thread segments 51 upon the closure 10 being ejected off the mold core has been significantly reduced as compared with forming each of the thread segments with a pointed end similar to point 54.

Figure 13:
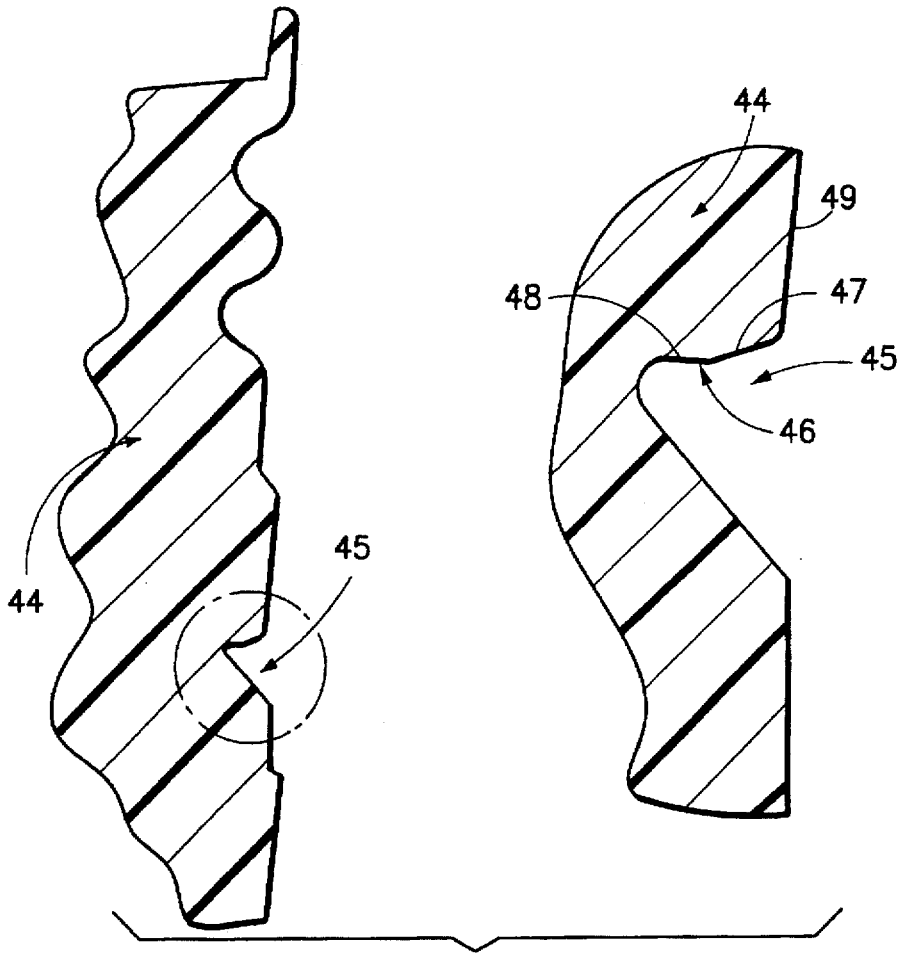
FIG. 13 is a vertical sectional view through a part of a mold used for the injection molding of closures according to the present invention with the area defining the rib being shown on an enlarged scales.

FIG. 13 depicts that part of a mold 44 used to mold the rib segments 19. It can be seen that the mold defines a recess 45 corresponding in a cross-sectional shape to the desired slope of the rib segments 19 and is divided into an outer first surface 47 and an inner second surface of the band 11. This first surface 47 is inclined to a plane normal the axis of the mold by an angle of 20°. The second surface 48 lies on the plan normal to the axis of the mold.

It will be appreciated by persons skilled in the art that numerous variations and/or modifications may be made to the invention as shown in the specific embodiment without departing from the spirit or scope of the invention. Merely, as an example, a second corresponding L-shaped slot may be positioned approximately diametrically across from the first L-shaped slot so that the tamper-evident band will rupture into two captive band portions retained by the closure. The present embodiments are, therefore, to be considered in all respects as illustrative and not restrictive.

What is claimed is:

1. A closure for a container having an externally screw threaded neck, the closure comprising a top portion and a depending skirt which has on its internal surface a complementary screw threads; a free edge of the depending skirt being joined by a plurality of frangible bridges and at least one non-frangible bridge to a tamper-evident band, the at least one non-frangible bridge having an extended circumferential length in relation to the circumferential length of the individual frangible bridges; the tamper-evident band comprising a generally cylindrical body portion and a segmented rib extending inwardly of the body portion and adapted to provide a lip to engage under a retaining flange extending outwardly from the neck of the container below the screw thread thereon an L-shaped slot extending radially through the side wall of the tamper-evident band, the slot having a first leg positioned adjacent the non-frangible bridge and extending in a generally downward direction from the top of the tamper-evident band, and a second leg extending generally circumferentially in the direction of the extended non-frangible bridge of the tamper-evident band; the second leg terminating at its end remote from the first leg of the L-shaped slot at a position axially under or directly adjacent to the extended non-frangible bridges; the body portion of the tamper-evident band having a frangible region extending between the bottom of the second leg of the L-shaped slot and the bottom of the body portion, such that when the closure is unscrewed and removed from the container the frangible bridges will break and the frangible region will break to remove the tamper-evident band with the closure and leave the tamper-evident band connected to the depending closure skirt by the non-frangible bridge.

2. The invention of claim 1, wherein the frangible region of the body portion is a radially thinned wall of the body portion of the tamper-evident band.

3. The invention of claim 1 or claim 2, wherein the frangible region of the body portion is positioned under the terminating end of the second leg remote from the first leg of the L-shaped slot.

4. The invention of claim 1, wherein the second leg extends under the non-frangible bridge a partial distance less than the circumferential ambit of the non-frangible bridge.

5. The invention of claim 1, wherein the side wall of the body portion of the tamper-evident band extending downwardly from the non-frangible bridge is substantially non-deformable in the axial direction when the closure is removed from the container.

6. The invention of claim 1, wherein a plurality of spaced apart radially inwardly extending projections are disposed on a radially inner surface of the band between the rib segments and a free edge of the band, the rib segments and the projections being generally positioned about the circumference of the band but being absent in circumferential regions adjacent to the L-shaped slot such that the regions of the body portion adjacent to the L-shaped slot may stretch when the closure is applied to a container.

7. The invention of claim 1 or claim 6, wherein the body portion of the tamper-evident band is provided with a plurality of longitudinally extending areas of localized thickening spaced apart about the radially outer surface of the band except at positions under the second leg of the L-shaped slot and except at positions approximately a quarter turn circumferentially removed from the L-shaped slot such that the positions circumferentially removed may stretch when the closure is applied to the container.

8. The invention of claim 1, wherein some of the frangible bridges are strengthened in relation to the remainder of the frangible bridges, one of such strengthened frangible bridges being positioned on the opposite side of the L-shaped slot from the extended non-frangible bridge.

9. The invention of claim 7, wherein some of the frangible bridges are strengthened in relation to the remainder of the frangible bridges, at least one each of such strengthened frangible bridges being positioned axially above the positions approximately a quarter turn circumferentially removed from the L-shaped slot.

10. The invention of claim 1, wherein the body portion of the tamper-evident band under the second leg of the L-shaped slot has substantial circumferential length to provide substantial stretching when the closure is applied to the container.

11. A closure for a container having an externally screw threaded neck, the closure comprising a top portion and a depending skirt which has on its internal surface a complementary screw thread; a free edge of the depending skirt being joined by a plurality of frangible bridges and a non-frangible bridge to a tamper-evident band; the tamper-evident band comprising a generally cylindrical body portion and a segmented rib extending inwardly of the body portion and adapted to provide a lip to engage under a retaining flange extending outwardly from the neck of the container below the screw thread thereon; a slot extending radially through the side wall of the tamper-evident band, the slot being spanned by a portion of the body portion of the tamper-evident band and having a frangible region, the frangible region lying at least in part directly under the non-frangible bridge, such that when the closure is unscrewed and removed from the container the frangible bridges will break and the frangible region will break to remove the tamper-evident band with the closure and leave the tamper-evident band connected to the depending closure skirt by the non-frangible bridge.

12. The invention of claim 11, wherein the slot is L-shaped with a substantial vertical and a substantially horizontal leg, the frangible region lying under the horizontal leg.

* * * * *